US010113716B2

(12) United States Patent
McCanless

(10) Patent No.: US 10,113,716 B2
(45) Date of Patent: Oct. 30, 2018

(54) LED LUMINAIRE WITH MOUNTING STRUCTURE FOR LED CIRCUIT BOARD

(71) Applicant: ABL IP Holding LLC, Decatur, GA (US)

(72) Inventor: Forrest Starnes McCanless, Oxford, GA (US)

(73) Assignee: ABL IP Holding LLC, Atlanta, GA (US)

( * ) Notice: Subject to any disclaimer, the term of this patent is extended or adjusted under 35 U.S.C. 154(b) by 152 days.

(21) Appl. No.: 15/247,224

(22) Filed: Aug. 25, 2016

(65) Prior Publication Data

US 2017/0059139 A1 Mar. 2, 2017

Related U.S. Application Data

(60) Provisional application No. 62/210,004, filed on Aug. 26, 2015.

(51) Int. Cl.
*F21V 17/16* (2006.01)
*F21V 23/00* (2015.01)
(Continued)

(52) U.S. Cl.
CPC ..... *F21V 17/164* (2013.01); *F21V 19/004* (2013.01); *F21V 23/001* (2013.01);
(Continued)

(58) Field of Classification Search
CPC .... F21V 23/001; F21V 19/045; F21V 15/015; F21V 21/04–21/041; F21V 21/044–21/045; F21V 21/048; F21V 21/049; F21V 19/003; F21V 19/004; F21V 19/0045; F21V 17/164; F21S 4/28; F21S 8/02–8/026; F21K 9/27; F21K 9/278; F21K 9/20; G02F 2001/133612; G02F 2001/133608
See application file for complete search history.

(56) References Cited

U.S. PATENT DOCUMENTS 3,019,333 A * 1/1962 Pascucci ..... F21S 8/02 220/3.8
5,934,915 A 8/1999 Henningsson et al.
(Continued)

FOREIGN PATENT DOCUMENTS

JP 2014116299 A * 6/2014

OTHER PUBLICATIONS

Machine translation of JP 2014116299 A, retrieved Mar. 6, 2018.*
(Continued)

*Primary Examiner* — Anh Mai
*Assistant Examiner* — Steven Horikoshi
(74) *Attorney, Agent, or Firm* — Kilpatrick Townsend & Stockton, LLP

(57) ABSTRACT

An LED luminaire includes a reflector, a channel, and a printed circuit board (PCB) onto which LEDs are mounted. Each of the reflector, the channel, and the PCB includes a feature(s) that permit their attachment to each other without the need for separate fasteners and tools. Embodiments of the LED luminaire may also include an optic and a pair of end caps, also designed for assembly into the LED luminaire without the use of or need for separate fasteners and tools.

15 Claims, 11 Drawing Sheets

(51) Int. Cl.

| | |
|---|---|
| ***F21V 19/00*** | (2006.01) |
| *F21V 15/015* | (2006.01) |
| *F21V 7/00* | (2006.01) |
| *F21Y 115/10* | (2016.01) |
| *F21Y 103/10* | (2016.01) |

(52) U.S. Cl.

CPC ..... *F21V 7/00* (2013.01); *F21V 15/015* (2013.01); *F21Y 2103/10* (2016.08); *F21Y 2115/10* (2016.08)

(56) References Cited

U.S. PATENT DOCUMENTS 6,114,626 A 9/2000 Barnes et al.
6,215,674 B1 4/2001 Bertolami
6,278,614 B1 8/2001 Beaman et al.
6,327,160 B1 12/2001 Liao
6,424,537 B1 7/2002 Paquin et al.
6,424,538 B1 7/2002 Paquin
6,428,352 B1 8/2002 Boyden
6,590,773 B1 7/2003 Lin
6,709,285 B1 3/2004 Chou et al.
6,771,512 B2 8/2004 Paquin et al.
6,937,475 B2 8/2005 Rigimbal et al.
6,964,581 B2 11/2005 Chen et al.
7,385,830 B2 6/2008 Liu et al.
7,396,247 B2 7/2008 Lin
7,612,299 B2 11/2009 Chen
8,449,145 B1 5/2013 Berry et al.
8,622,361 B2 1/2014 Wronski
8,629,574 B2 1/2014 Porter et al.
8,629,631 B1 1/2014 Rhodes et al.
8,629,750 B2 1/2014 Spalding
8,632,214 B1 1/2014 Tickner et al.
8,633,391 B2 1/2014 Strong et al.
8,634,482 B2 1/2014 Towers et al.
8,636,387 B1 1/2014 Wronski et al.
8,638,537 B2 1/2014 Kester et al.
D698,975 S 2/2014 Blessitt et al.
D698,978 S 2/2014 Bryant
D699,681 S 2/2014 Slack
D700,382 S 2/2014 Christ et al.
8,646,936 B2 2/2014 Goyal et al.
8,646,948 B1 2/2014 Reo et al.
8,649,882 B2 2/2014 Stelzer et al.
8,654,869 B2 2/2014 Jones et al.
8,659,279 B2 2/2014 George et al.
8,659,379 B2 2/2014 Yan et al.
8,659,860 B2 2/2014 George et al.
8,659,866 B2 2/2014 Douglass et al.
D700,987 S 3/2014 Nepple et al.
8,669,720 B2 3/2014 Goyal et al.
8,673,855 B2 3/2014 Kim et al.
8,675,332 B1 3/2014 Green et al.
8,680,756 B2 3/2014 Rong et al.
D701,988 S 4/2014 Clements
D702,640 S 4/2014 Restrepo et al.
D702,866 S 4/2014 Blincoe et al.
D703,139 S 4/2014 Dodal et al.
8,686,662 B1 4/2014 Bragg et al.
8,690,198 B2 4/2014 Saber et al.
8,690,595 B2 4/2014 Barna
8,692,139 B2 4/2014 Aldrich et al.
8,696,169 B2 4/2014 Tickner et al.
8,699,197 B2 4/2014 Douglass et al.
8,699,198 B2 4/2014 Spalding
8,699,209 B2 4/2014 Barna
8,701,372 B2 4/2014 Nuernberger et al.
8,702,047 B2 4/2014 Nuernberger et al.
8,706,828 B2 4/2014 Brabec et al.
8,708,518 B1 4/2014 Ehresman et al.
8,712,052 B2 4/2014 Landheer
D705,734 S 5/2014 Dodal et al.
D705,974 S 5/2014 Blessitt et al.
8,715,008 B2 5/2014 von zur Muehlen
8,720,791 B2 5/2014 Slingsby et al.
8,721,112 B2 5/2014 Hetrick et al.
8,721,120 B2 5/2014 Christ et al.
8,726,587 B2 5/2014 Nuernberger et al.
8,727,573 B2 5/2014 Holder
8,729,396 B2 5/2014 Zhang et al.
8,746,921 B1 6/2014 Bigge
8,746,927 B1 6/2014 Nepple et al.
8,751,066 B1 6/2014 Towers et al.
8,754,341 B2 6/2014 Manahan et al.
8,760,151 B2 6/2014 Mcbee et al.
8,760,254 B2 6/2014 Mcbee et al.
8,764,220 B2 7/2014 Chan et al.
8,766,821 B2 7/2014 Restrepo et al.
8,774,622 B2 7/2014 Weintraub et al.
8,777,460 B2 7/2014 Newton
8,777,535 B2 7/2014 Manahan
8,777,678 B2 7/2014 Barna
8,779,284 B2 7/2014 Wagner et al.
8,779,675 B2 7/2014 Mikani et al.
8,779,691 B1 7/2014 Rhodes
8,779,693 B1 7/2014 Blalock et al.
8,785,804 B2 7/2014 Gibson
8,789,978 B2 7/2014 Tickner et al.
D711,031 S 8/2014 Moghal et al.
D711,032 S 8/2014 Moghal et al.
D711,037 S 8/2014 Lehman et al.
D712,082 S 8/2014 Harpenau et al.
8,794,792 B1 8/2014 Moghal et al.
8,794,803 B1 8/2014 Paulsel
8,797,773 B2 8/2014 George
8,808,032 B2 8/2014 Fischer et al.
8,808,033 B2 8/2014 White
8,816,654 B2 8/2014 Kletti et al.
8,817,471 B2 8/2014 Barna
D712,581 S 9/2014 Scarlata et al.
D713,081 S 9/2014 Scarlata et al.
8,820,985 B1 9/2014 Tam et al.
8,821,622 B2 9/2014 Manahan et al.
8,830,023 B2 9/2014 Darr
8,830,645 B2 9/2014 Kojovic
8,844,749 B2 9/2014 Manahan et al.
8,845,129 B1 9/2014 Holder et al.
8,845,141 B2 9/2014 Wronski et al.
8,845,144 B1 9/2014 Davis et al.
8,845,145 B1 9/2014 Tam et al.
8,845,793 B2 9/2014 Manahan et al.
8,848,486 B1 9/2014 Elwell
D714,992 S 10/2014 Bryant
D715,480 S 10/2014 Christ et al.
D716,489 S 10/2014 O'Leary et al.
8,851,437 B2 10/2014 Verma et al.
8,851,711 B2 10/2014 Ladewig et al.
8,853,942 B1 10/2014 Lewis, Jr. et al.
8,854,174 B2 10/2014 Su et al.
8,858,053 B1 10/2014 Patrick et al.
8,866,485 B1 10/2014 Lacey et al.
D717,486 S 11/2014 Lowell
D718,485 S 11/2014 Wright
D718,489 S 11/2014 Wronski et al.
8,876,328 B2 11/2014 Wegner
8,882,057 B2 11/2014 Dworak, Jr.
8,884,549 B2 11/2014 Shah et al.
D719,511 S 12/2014 Dodal et al.
D719,688 S 12/2014 Goyal et al.
D719,699 S 12/2014 Bryant
D720,295 S 12/2014 Dodal et al.
8,899,786 B1 12/2014 Moghal et al.
8,904,606 B2 12/2014 Aldrich et al.
8,905,441 B2 12/2014 Barna
8,905,602 B2 12/2014 Thompson, III
8,907,582 B2 12/2014 Neundorfer et al.
8,907,587 B2 12/2014 Guckin et al.
8,908,357 B2 12/2014 Manahan
8,910,141 B2 12/2014 Bahls et al.
8,910,373 B2 12/2014 Yan et al.
8,911,116 B2 12/2014 Blincoe et al.
8,911,121 B2 12/2014 Tickner et al.
8,911,132 B1 12/2014 Foy et al.

(56) References Cited

U.S. PATENT DOCUMENTS 8,911,264 B2 12/2014 Goyal et al.
8,913,244 B1 12/2014 Broughton
8,915,609 B1 12/2014 Shah et al.
8,915,624 B2 12/2014 Manahan
8,926,360 B2 1/2015 Manahan et al.
8,928,242 B2 1/2015 Goyal et al.
8,939,418 B2 1/2015 Green et al.
8,939,608 B1 1/2015 Patrick
8,939,615 B2 1/2015 Rong et al.
8,941,021 B2 1/2015 Gouhl et al.
8,941,457 B2 1/2015 Yan et al.
D722,562 S 2/2015 Restrepo et al.
D723,206 S 2/2015 Lewis, Jr. et al.
8,944,627 B1 2/2015 Hetrick
8,956,170 B2 2/2015 White
8,957,649 B2 2/2015 Kromrey et al.
8,958,183 B2 2/2015 Lacey et al.
8,960,971 B1 2/2015 Newton
8,960,973 B1 2/2015 Kathawate et al.
8,968,036 B2 3/2015 Ledgerwood et al.
8,969,741 B2 3/2015 Aldrich et al.
8,974,074 B1 3/2015 Duchesneau et al.
8,979,329 B1 3/2015 Moore et al.
8,979,559 B2 3/2015 Aldrich et al.
8,979,600 B2 3/2015 von zur Muehlen et al.
8,988,183 B2 3/2015 Darr et al.
8,992,649 B2 3/2015 Manahan et al.
8,994,296 B1 3/2015 Chan
8,994,354 B2 3/2015 George
D726,359 S 4/2015 Grigore et al.
D726,940 S 4/2015 Goyal et al.
D727,546 S 4/2015 Goyal et al.
D728,153 S 4/2015 Blessitt
8,998,440 B1 4/2015 Wu et al.
9,000,736 B2 4/2015 Gumaer
9,000,875 B2 4/2015 Mcbee et al.
9,004,435 B2 4/2015 Wronski
9,007,037 B2 4/2015 Daley et al.
9,010,956 B1 4/2015 Davis
9,017,093 B1 4/2015 Packard, III et al.
9,020,648 B2 4/2015 Doljack
D729,432 S 5/2015 Newton et al.
9,022,603 B1 5/2015 Moghal et al.
9,025,315 B2 5/2015 Rustomji et al.
9,033,547 B2 5/2015 Manahan et al.
9,033,550 B1 5/2015 Tickner
D731,970 S 6/2015 Kamath et al.
9,046,231 B2 6/2015 Christ et al.
9,052,070 B2 6/2015 Davis et al.
9,052,081 B1 6/2015 Paulsel
9,052,086 B2 6/2015 Broughton
9,052,090 B1 6/2015 Laso et al.
9,052,097 B2 6/2015 Blincoe et al.
9,052,101 B1 6/2015 Kathawate et al.
9,053,863 B2 6/2015 Rustomji et al.
9,055,623 B1 6/2015 Bohler et al.
9,060,607 B1 6/2015 Canales
9,062,837 B2 6/2015 Wronski et al.
9,062,849 B2 6/2015 Gennetten et al.
9,062,866 B1 6/2015 Christ et al.
9,068,722 B2 6/2015 Wronski et al.
9,069,106 B1 6/2015 Blessitt et al.
D735,144 S 7/2015 Restrepo et al.
D735,391 S 7/2015 Blessitt et al.
D735,401 S 7/2015 Clements
D735,402 S 7/2015 Goyal et al.
9,080,739 B1 7/2015 Sayers
9,080,747 B1 7/2015 Hetrick
9,083,180 B2 7/2015 Dodal et al.
9,084,306 B1 7/2015 Bohler et al.
9,086,198 B2 7/2015 Wronski et al.
9,086,214 B1 7/2015 Blalock et al.
9,088,220 B2 7/2015 Bavel
9,093,764 B2 7/2015 Manahan et al.
9,253,848 B2 2/2016 Hayman et al.
9,458,869 B2 10/2016 Van Gompel et al.
9,587,810 B2 3/2017 Parekh
9,588,274 B2 3/2017 Zhou
2004/0114364 A1* 6/2004 Chen ..... F21S 8/04 362/225
2008/0298058 A1 12/2008 Kan et al.
2009/0135583 A1* 5/2009 Hillman ..... G02F 1/133603 362/97.1
2009/0323334 A1* 12/2009 Roberts ..... F21V 5/002 362/247
2010/0226125 A1* 9/2010 Liao ..... F21V 19/004 362/235
2013/0100622 A1 4/2013 Wang et al.
2013/0128572 A1* 5/2013 Yoshizawa ..... F21V 7/00 362/235
2013/0278860 A1* 10/2013 Choi ..... G02F 1/133308 349/58
2014/0009931 A1 1/2014 Tickner et al.
2014/0013940 A1 1/2014 Manahan et al.
2014/0013948 A1 1/2014 Manahan et al.
2014/0014163 A1 1/2014 McCarthy et al.
2014/0015419 A1 1/2014 Shah et al.
2014/0019397 A1 1/2014 Alexander
2014/0021867 A1 1/2014 Shah et al.
2014/0023193 A1 1/2014 Landheer
2014/0028218 A1 1/2014 Guckin et al.
2014/0036544 A1 2/2014 Bavel
2014/0036694 A1 2/2014 Courtice
2014/0043133 A1 2/2014 Douglass
2014/0049956 A1 2/2014 Manahan et al.
2014/0049962 A1 2/2014 Holder et al.
2014/0054025 A1 2/2014 DeCarr et al.
2014/0058575 A1 2/2014 Ashworth et al.
2014/0061399 A1 3/2014 Nuernberger
2014/0062330 A1 3/2014 Neundorfer et al.
2014/0062340 A1 3/2014 Elgayyar
2014/0065874 A1 3/2014 Ledgerwood et al.
2014/0069711 A1 3/2014 Barna
2014/0071687 A1 3/2014 Tickner et al.
2014/0076897 A1 3/2014 Manahan et al.
2014/0076901 A1 3/2014 Manahan et al.
2014/0085776 A1 3/2014 Fischer et al.
2014/0085905 A1 3/2014 Broughton
2014/0087600 A1 3/2014 von zur Muehlen et al.
2014/0088776 A1 3/2014 Brandt et al.
2014/0088777 A1 3/2014 Allmaras et al.
2014/0090242 A1 4/2014 Barna
2014/0091582 A1 4/2014 Manahan
2014/0091583 A1 4/2014 Manahan
2014/0097966 A1 4/2014 Alexander
2014/0102780 A1 4/2014 Aldrich et al.
2014/0103175 A1 4/2014 Neace
2014/0104846 A1 4/2014 Wronski
2014/0111075 A1 4/2014 Schneider et al.
2014/0113500 A1 4/2014 Goyal et al.
2014/0117188 A1 5/2014 Wronski
2014/0117768 A1 5/2014 Goyal
2014/0118907 A1 5/2014 Fellers et al.
2014/0123123 A1 5/2014 Bahls
2014/0126205 A1 5/2014 Davis et al.
2014/0126243 A1 5/2014 Blessitt et al.
2014/0138146 A1 5/2014 Li et al.
2014/0151203 A1 6/2014 Gouhl et al.
2014/0153144 A1 6/2014 Lacey et al.
2014/0153235 A1 6/2014 Gennetten et al.
2014/0153260 A1 6/2014 Wronski
2014/0158510 A1 6/2014 Lacey et al.
2014/0160742 A1* 6/2014 Rodgers ..... F21V 23/02 362/222
2014/0167934 A1 6/2014 Fair et al.
2014/0176011 A1 6/2014 Szabados
2014/0177169 A1 6/2014 Restrepo et al.
2014/0197261 A1 7/2014 Witherbee
2014/0198419 A1 7/2014 Kojovic
2014/0198420 A1 7/2014 Kojovic
2014/0199869 A1 7/2014 Manahan et al.
2014/0199881 A1 7/2014 Manahan et al.
2014/0209620 A1 7/2014 Barna
2014/0213191 A1 7/2014 Courtice

(56) References Cited

U.S. PATENT DOCUMENTS

2014/0213311 A1 7/2014 Courtice
2014/0238726 A1 8/2014 Kamath et al.
2014/0240980 A1* 8/2014 Howe ..... F21V 3/0625 362/235
2014/0241533 A1 8/2014 Gerrish et al.
2014/0241735 A1 8/2014 Bohler et al.
2014/0246567 A1 9/2014 Goyal et al.
2014/0251774 A1 9/2014 Gouhl et al.
2014/0254065 A1 9/2014 Rustomji et al.
2014/0254066 A1 9/2014 Rustomji et al.
2014/0254152 A1 9/2014 Bohler et al.
2014/0254220 A1 9/2014 George et al.
2014/0256188 A1 9/2014 Manahan et al.
2014/0263865 A1 9/2014 Salian et al.
2014/0264983 A1 9/2014 Cape
2014/0265556 A1 9/2014 Sama Rubio et al.
2014/0265637 A1 9/2014 Kaluzny et al.
2014/0266142 A1 9/2014 Schaar
2014/0266240 A1 9/2014 Haensgen et al.
2014/0266539 A1 9/2014 Krishnamoorthy et al.
2014/0266555 A1 9/2014 Krishnamoorthy et al.
2014/0268647 A1 9/2014 Blondin et al.
2014/0268869 A1 9/2014 Blessitt et al.
2014/0268874 A1 9/2014 Clements et al.
2014/0269704 A1 9/2014 Alexander et al.
2014/0270798 A1 9/2014 Manahan
2014/0272542 A1 9/2014 Rustomji
2014/0278150 A1 9/2014 Baesler et al.
2014/0283461 A1 9/2014 Zhang et al.
2014/0283462 A1 9/2014 Zhang et al.
2014/0283475 A1 9/2014 Zhang et al.
2014/0283480 A1 9/2014 Zhang et al.
2014/0283481 A1 9/2014 Zhang et al.
2014/0299730 A1 10/2014 Green et al.
2014/0300192 A1 10/2014 Price et al.
2014/0301087 A1 10/2014 Wronski et al.
2014/0301092 A1 10/2014 Wronski et al.
2014/0312691 A1 10/2014 Doljack et al.
2014/0313003 A1 10/2014 Liu et al.
2014/0313776 A1 10/2014 Grigore
2014/0313778 A1 10/2014 Getzinger et al.
2014/0321131 A1 10/2014 Newton
2014/0326498 A1 11/2014 Romano
2014/0327411 A1 11/2014 Gumaer
2014/0328096 A1 11/2014 Gumaer
2014/0328097 A1 11/2014 Gumaer
2014/0328415 A1 11/2014 Gumaer
2014/0332249 A1 11/2014 Barna
2014/0334155 A1 11/2014 Christ et al.
2014/0347037 A1 11/2014 Mcbee et al.
2015/0002024 A1 1/2015 Shah et al.
2015/0008666 A1 1/2015 Stanzione
2015/0009004 A1 1/2015 Zhou et al.
2015/0009678 A1 1/2015 Hunter
2015/0020873 A1 1/2015 Nuernberger et al.
2015/0026976 A1 1/2015 Ledgerwood et al.
2015/0049405 A1 2/2015 Ramarge et al.
2015/0050078 A1 2/2015 Laughlin
2015/0055370 A1 2/2015 Gongola et al.
2015/0062910 A1 3/2015 Winters
2015/0076156 A1 3/2015 Manahan et al.
2015/0076841 A1 3/2015 Zhao et al.
2015/0076989 A1 3/2015 Walma et al.
2015/0076992 A1 3/2015 Walma
2015/0085504 A1 3/2015 Patrick et al.
2015/0087181 A1 3/2015 Manahan et al.
2015/0092425 A1 4/2015 Thompson, III et al.
2015/0100163 A1 4/2015 Allmaras et al.
2015/0103536 A1 4/2015 Wronski et al.
2015/0131271 A1 5/2015 Green et al.
2015/0132080 A1 5/2015 Tran
2015/0132581 A1 5/2015 Li et al.
2015/0132982 A1 5/2015 Hagerty et al.
2015/0132983 A1 5/2015 Daly et al.
2015/0137934 A1 5/2015 von zur Muehlen et al.
2015/0146421 A1 5/2015 Scarlata et al.
2015/0148456 A1 5/2015 Eissmann et al.
2015/0170820 A1 6/2015 Kadir
2015/0176631 A1 6/2015 McCarthy et al.
2015/0177306 A1 6/2015 Hedlund et al.
2015/0179372 A1 6/2015 Gouhl et al.
2015/0198298 A1 7/2015 Scarlata et al.
2015/0198308 A1 7/2015 Patrick
2015/0198310 A1 7/2015 Scarlata et al.
2015/0207282 A1 7/2015 Packard, III et al.
2015/0208320 A1 7/2015 Alexander et al.
2015/0215027 A1 7/2015 Lacey

OTHER PUBLICATIONS

"LT-F562A_G2", Available online at: http://www.samsung.com/global/business/led/products/led-engine/ambient-light-engine (Mar. 28, 2016) (16 pages).
"M-series 4ft", Available online at: http://www.samsung.com/global/business/led/products/led-engine/ambient-light-engine (Apr. 22, 2016) (17 pages).
Cooperindustries , Available online at: http://www.cooperindustries.com/content/public/en/lighting/products/recessed_linear_lighting/direct_indirect/_866921.html (2017) (10 pages).
Cooperindustries , "Cooper Lighting—METALUX", Available online at: http://www.cooperindustries.com/content/dam/public/lighting/products/documents/metalux/spec_sheets/110042_Cruze_Retro_2x2.pdf, 2 pages (Available at least on Aug. 12, 2015).
Cooperindustries , "Cooper Lighting—METALUX", available online at: http://www.cooperindustries.com/content/dam/public/lighting/products/documents/metalux/spec_sheets/101331_Cruze_Retro_2x4.pdf, 3 pages (Available at least on Aug. 12, 2015).
"Ambient Light Engine Samsung LED Global," H Series Gen3, available online at http://www.samsung.com/global/business/led/products/led-engine/ambient-light-engine (2 pages) (Available at least on Oct. 21, 2016).

* cited by examiner

LED LUMINAIRE WITH MOUNTING STRUCTURE FOR LED CIRCUIT BOARD

REFERENCE TO RELATED APPLICATIONS

This application claims the benefit of U.S. Provisional Application Ser. No. 62/210,004, filed on Aug. 26, 2015, and entitled LED LUMINAIRE ASSEMBLY, the content of which is hereby incorporated in its entirety by this reference.

FIELD OF THE INVENTION

Embodiments of the present invention provide means by which to assemble various components of a light emitting diode (LED) luminaire whereby the components engage each other without the need for separate mechanical fasteners.

BACKGROUND

Assembling luminaires, such as an LED luminaire, typically requires an assembler to perform a multitude of operations with a number of various tools and fasteners. In various situations, such as during high volume fabrication of lighting assemblies, the time (and thus associated cost) required to assemble the luminaires is increased because of the number of tools and fasteners needed. Therefore, there is a need for a lighting assembly that is easy to assemble in various situations including, but not limited to, high volume fabrication manufacturing.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, an LED luminaire includes a reflector, a channel, and a printed circuit board (PCB) onto which LEDs are mounted. Each of the reflector, the channel, and the PCB includes a feature(s) that permit their attachment to each other without the need for separate fasteners and tools. Embodiments of the LED luminaire may also include an optic and a pair of end caps, also designed for assembly into the LED luminaire without the use of or need for separate fasteners and tools.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Figure 1:
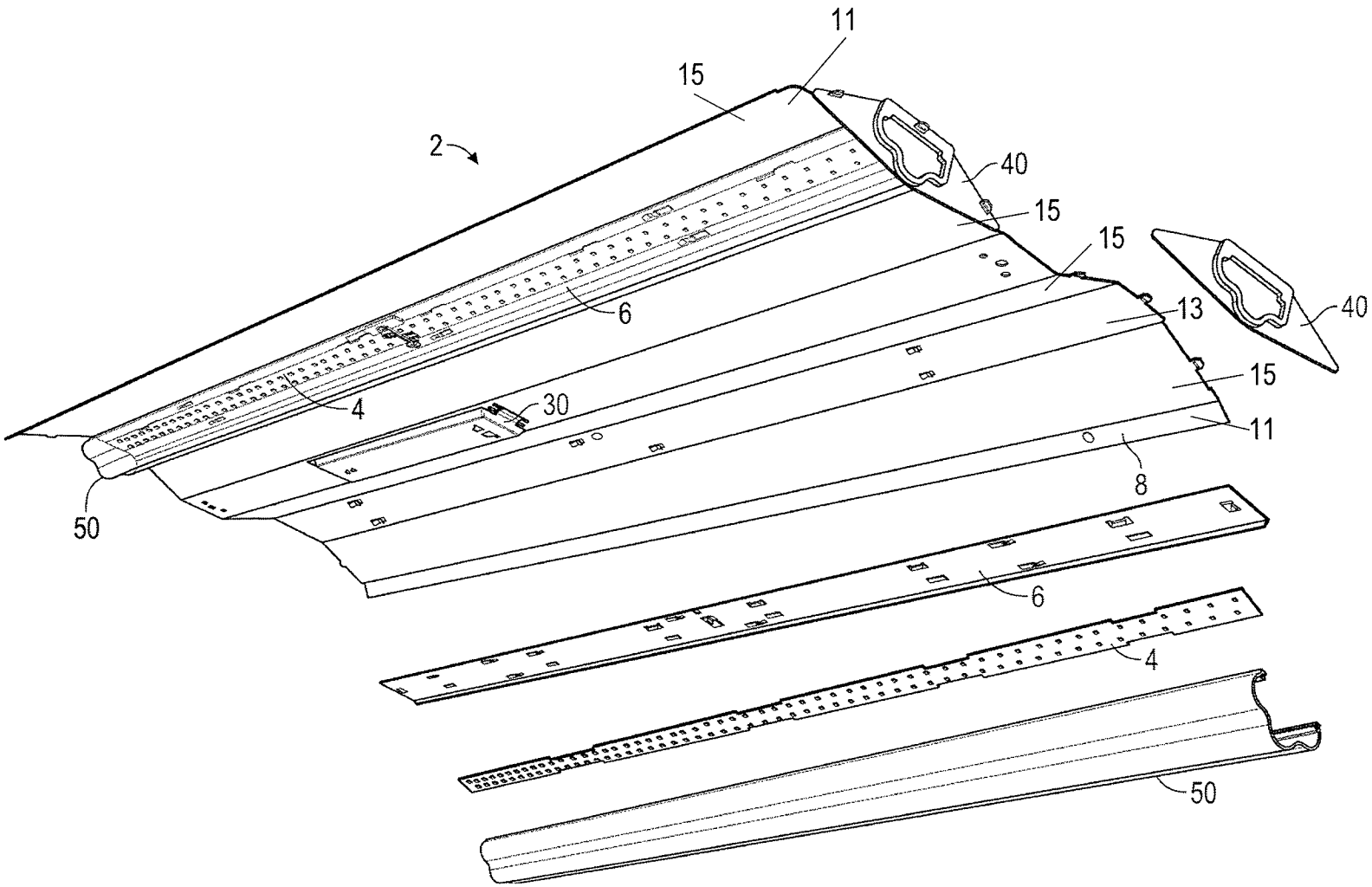
FIG. 1 is a partially exploded perspective view of a LED luminaire according to an embodiment of the present invention, the LED luminaire of FIG. 1 including a reflector, channel, LED boards and an optic.

Referring to FIG. 1, in one embodiment, a LED luminaire 2 includes one or more printed circuit boards (PCB) 4 with LEDs 3 retained on one or more channels 6, which in turn is retained on a reflector 8. In various examples, one or more end caps 40 may be positioned on each of the ends of the reflector 8 (end caps 40 are only shown on one end of the reflector in FIG. 1). An optic 50 may be positioned over the LEDs 3 to enclose the LEDs 3 within the LED luminaire 2.

The Reflector

Figure 2:
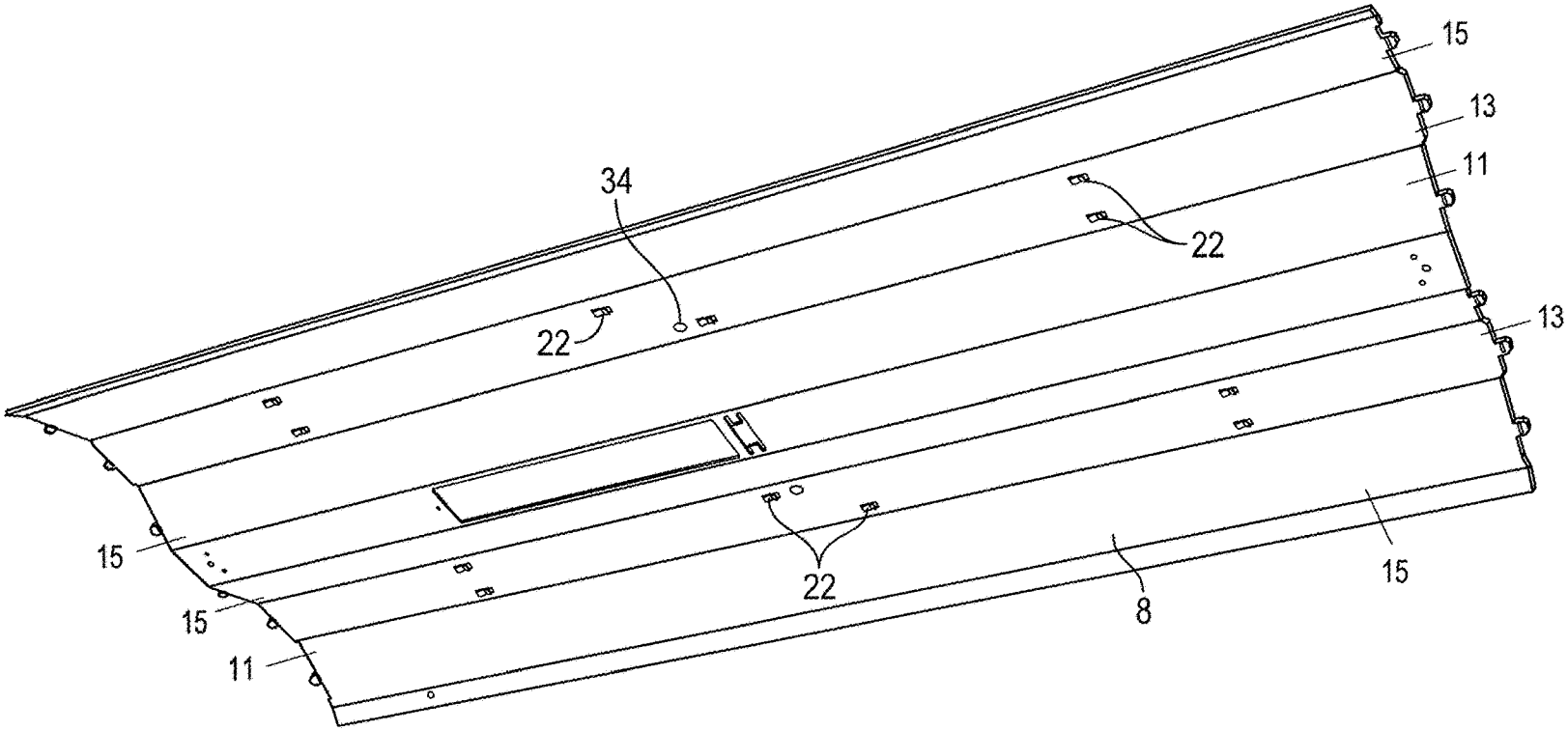
FIG. 2 is a perspective view of the reflector of the LED luminaire of FIG. 1.
Figure 3:
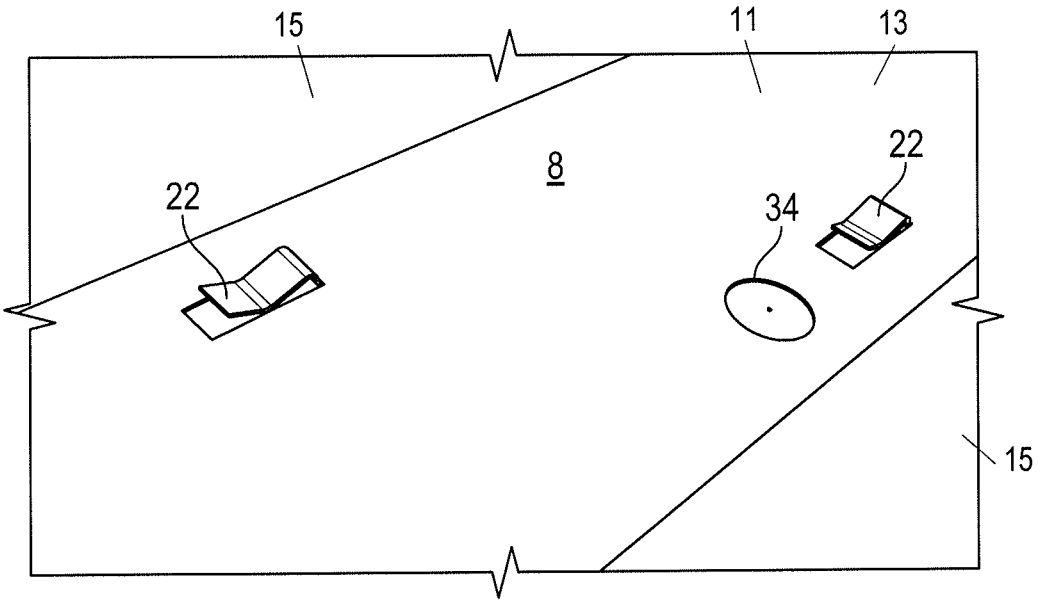
FIG. 3 is a detail view of reflector clips of the reflector of FIG. 2.
Figure 4:
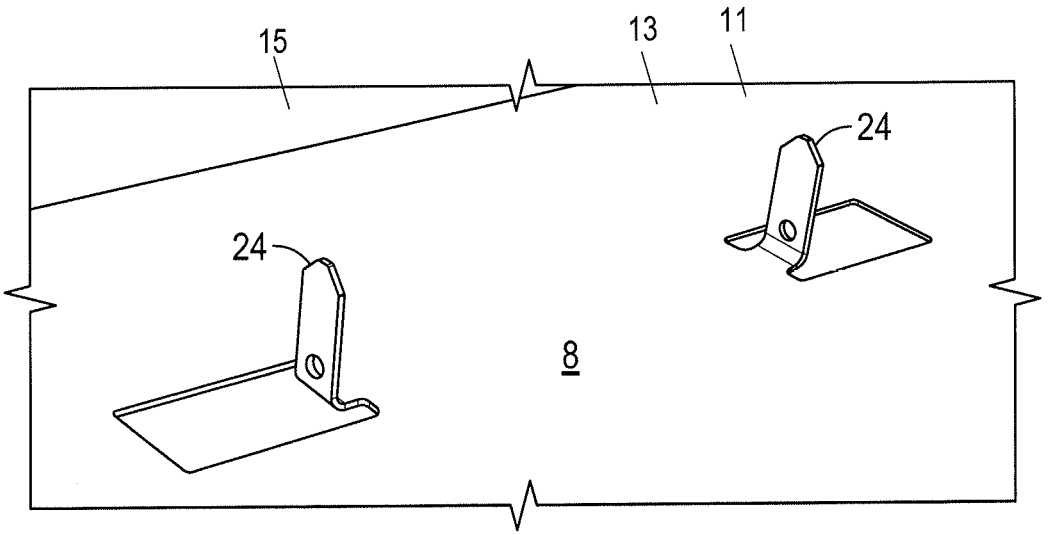
FIG. 4 is a detail view of arms of a reflector according to an embodiment of the present invention.

Details of the reflector of FIG. 1 are shown in FIGS. 2-4. The reflector may be formed to have any shape or dimension. For example and without limitation, while the illustrated reflector 8 is shown having two troughs 11 (each provided with an associated channel 6, LEDs 3, end caps 40, etc.), the reflector 8 could have only a single trough or more than two troughs.

Each trough 11 includes a channel-receiving portion 13 from which sidewalls 15 downwardly extend. The reflector may be formed integrally or, alternatively, the various reflector components may be formed separately and assembled together to form the reflector. The reflector may be formed of any suitable material, including metallic and polymeric materials. The surface of the sidewalls 15 preferably has an extremely high surface reflectivity, preferably, but not necessarily, between 96%-99.5%, inclusive and more preferably 98.5-99%. To achieve the desired reflectivity, in one embodiment the reflective surface comprises polished metals such as, but not limited to, polished aluminum. In other embodiments, reflective coatings, including reflective paints or other reflective compositions, are applied to the reflector to attain the desired reflectivity.

Referring to FIGS. 2 and 3, in some examples, the reflector 8 includes reflector clips 22 that engage the channel 6 to retain the channel 6 on the reflector 8, as described in detail below. In other embodiments, as illustrated in FIG. 4, the reflector 8 includes reflector arms 24, which may be bent to secure the PCB 4, channel 6, and reflector 8 together, as described in more detail below. In various other embodiments, various combinations, positions, and orientations of reflector clips 22 and reflector arms 24 may be utilized. In some examples, a wireway 34 is provided in the reflector 8 for permitting wires 32 to pass therethrough and reach the PCBs 4.

The Channel(s)

At least one channel 6 is provided in each reflector trough 11. As illustrated in FIGS. 5-8, the channel 6 includes a number of tabs and apertures, which may be used to retain the PCB 4 on the channel 6 and the channel 6 on the reflector 8, as described in more detail below. An upstanding end tab 12 (see FIG. 6) is provided on each end of the channel 6. Side channel tabs 16 (see FIG. 7) are provided at locations along the length of the channel 6 to capture edges of the PCBs 4.

Figure 8:
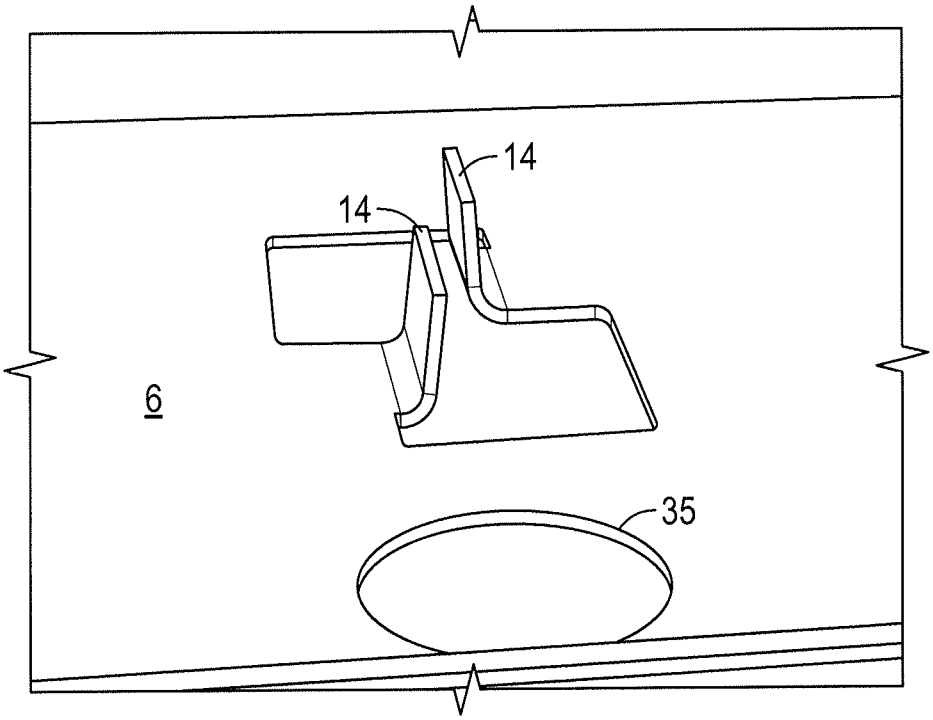
FIG. 8 is a detail view of central tabs of the channel of FIG. 5.

In some examples, as illustrated in FIG. 8, the channel 6 is shown configured to accommodate two PCBs 4 positioned in series, and includes a set of upstanding central tabs 14 provided more centrally on the channel 6. However, one of skill will understand that the channel 6 could accommodate a single PCB 4 (in which case the pair of central tabs 14 would be unnecessary) or more than two PCBs 4 (in which case more than one pair of central tabs 14 could be used).

Figure 5:
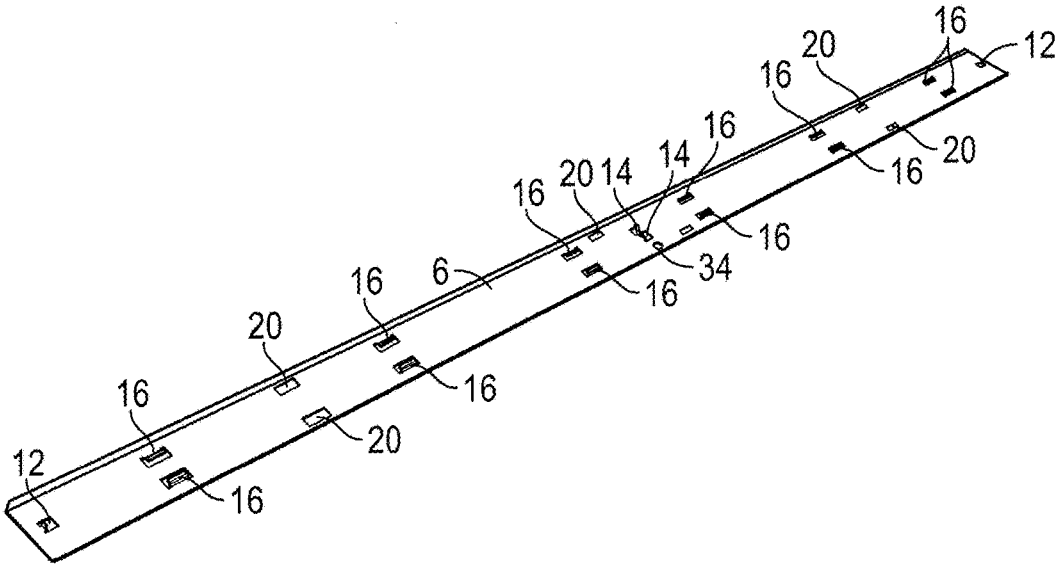
FIG. 5 is a perspective view of one of the channels of the LED luminaire of FIG. 1.
Figure 6:
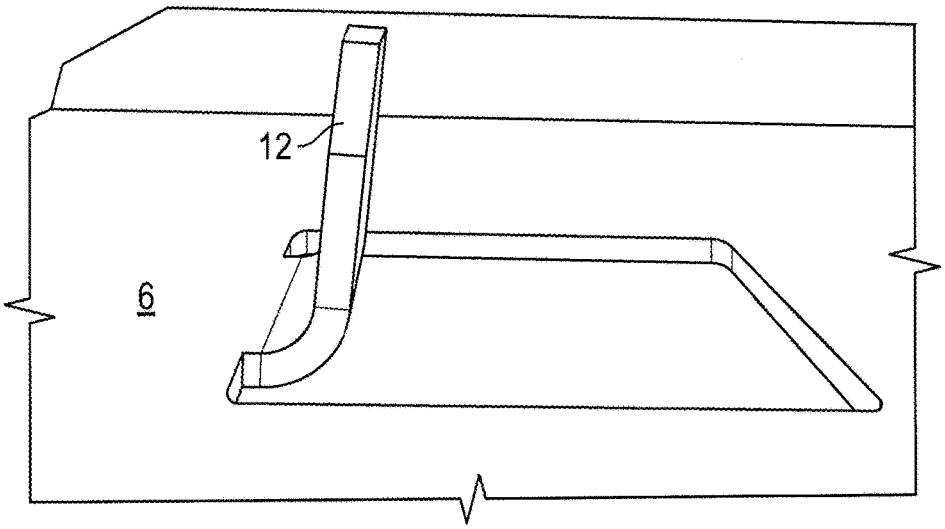
FIG. 6 is a detail view of an end tab of the channel of FIG. 5.
Figure 7:
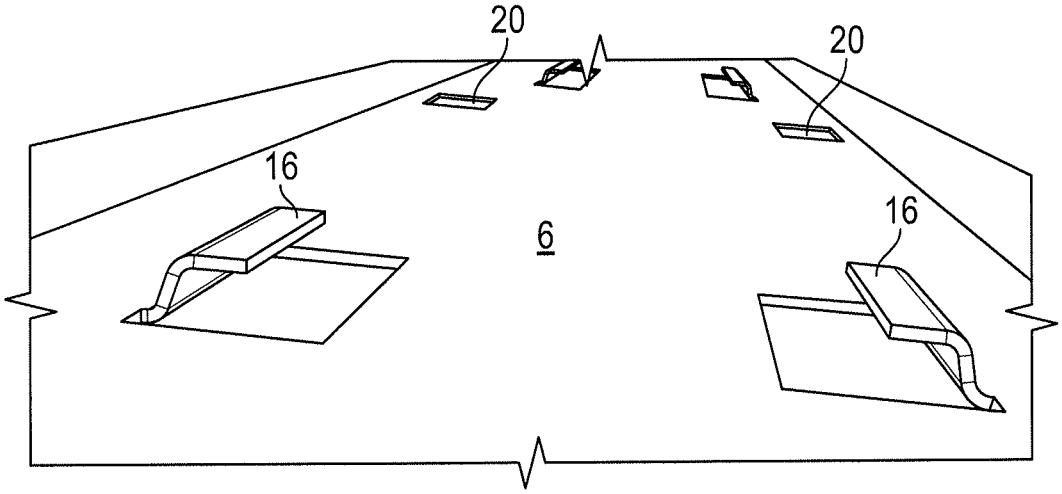
FIG. 7 is a detail view of side channel tabs of the channel of FIG. 5.

Moreover, while three pairs of side channel tabs 16 are shown in FIG. 5 for supporting each PCB 4, the number of side channel tabs 16 should not be considered limiting on the current disclosure as additional or fewer side channel tabs 16 may be provided. In some examples, the side channel tabs 16 may be provided directly across from each other on the channel 6. In other examples, the side channel tabs 16 of the channel 6 need not be oriented directly across from each other, but rather could be staggered.

Clip apertures 20 are also formed in the channel 6 to facilitate attachment to the reflector, as described below. In some examples, a wireway 35 is also provided in the channel 6. The wireway 35 may be aligned with the wireway 34 of the reflector 8 for permitting wires 32 to pass therethrough and reach the PCBs 4.

The PCBs

Figure 9:
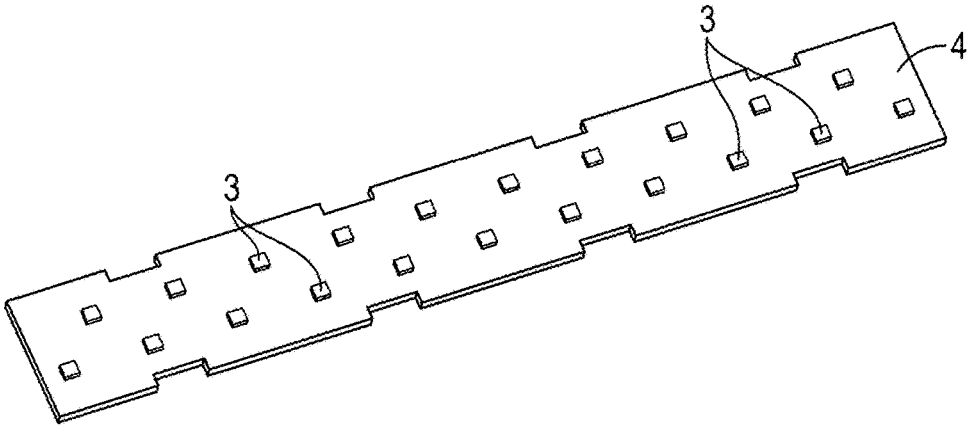
FIG. 9 is a perspective view of a PCB of the LED luminaire of FIG. 1.

Referring to FIG. 9, each PCB 4 may be populated with any number of LEDs 3 oriented in any way on the PCB 4. The LEDs may be single-die or multi-die LEDs, DC or AC, or can be organic light emitting diodes. White, color, or multicolor LEDs may be used. Moreover, the LEDs need not all be the same color; rather, mixtures of LEDs may be used. The PCB 4 can be, among other things, metal core board, FR4 board, CHM1 board, etc. In some embodiments, the PCB 4 is a substantially rigid board that elastically deforms. In other words, when flexed below its yield point, PCB 4 attempts to recover and return to its naturally flat state (as opposed to plastic deformation where the board would be permanently deformed with no ability to return to its original shape). The "springiness" of the PCB 4 can facilitate installation, as described below.

Pairs of notches 10 are provided along the side edges of the PCB 4 along the length of the PCB 4. While not required, the number of pairs of notches 10 on the PCB 4 may be the same as the number of pairs of side channel tabs 16 provided on channel 6. In some examples, the notches 10 on the PCB 4 are oriented directly across from each other, although they need not be. For example and without limitation, in other examples, the notches 10 could be staggered to accommodate staggered side channel tabs 16 during installation of the PCB 4 onto the channel 6. While rectangular notches 10 are illustrated in some figures, in other embodiments at least one notch edge is beveled, rounded, or have any other shape such that the notches 10 are not rectangular. For example, in some embodiments, providing notches 10 having beveled leading edges may help with sliding of the PCB 4 under the side channel tabs 16, as described in detail below. These beveled edges may also serve as a visual clue to the proper orientation of the PCB 4 relative to the channel 6.

In some embodiments, a driver (not shown) for powering the LEDs 3 is located above the reflector 8. It some non-limiting embodiments, the driver might be mounted to an upper surface of the reflector 8. A door 30 may optionally be provided in the reflector 8 for accessing, servicing, and/or replacing the driver.

The Optic(s)

An optional optic 50 may be positioned over the LEDs of each reflector trough 11. The optic 50 may be of any type (diffuse, prismatic, etc.) that achieves the desired light emission from the LED luminaire 2. The optic 50 may have any geometry, and may be provided with any surface enhancements or with no surface enhancements. By way only of example, the optic 50 could have the shape of the optics disclosed in U.S. patent application Ser. No. 14/696,042, filed on Apr. 24, 2015 and entitled "Tri-Lobe Optic and Associated Light Fixtures," the entirety of which is herein incorporated by reference.

Assembly of the LED Luminaire 2

Figure 10:
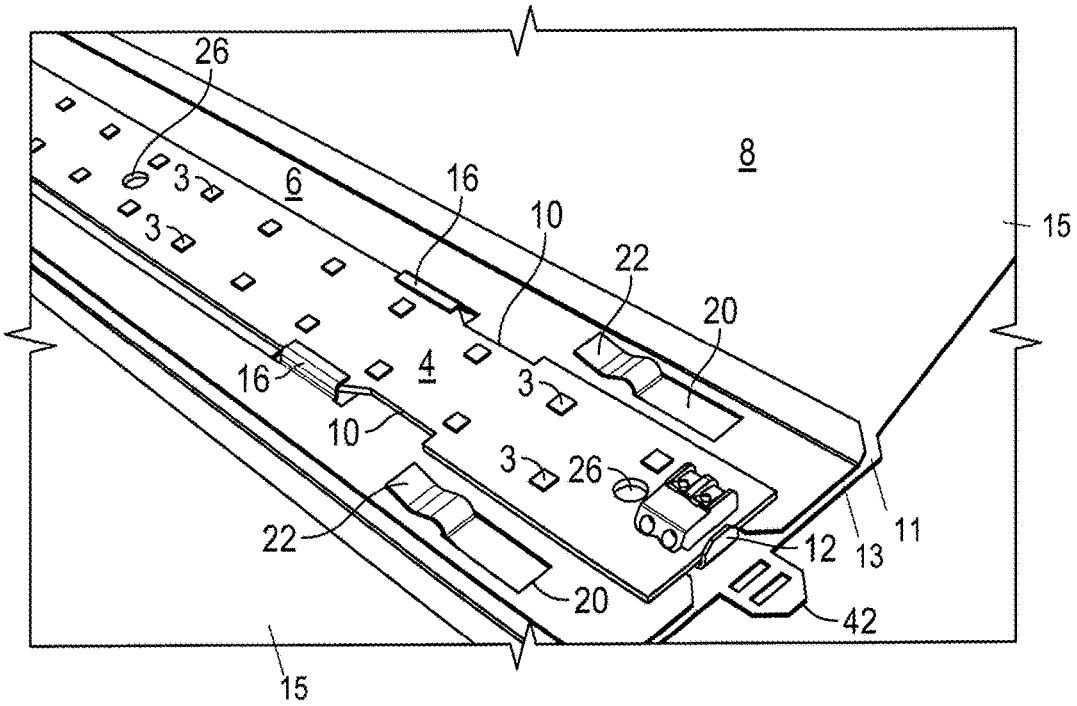
FIG. 10 is a partial perspective view of the LED board of FIG. 9 retained on the channel of FIG. 5, which is retained on the reflector of FIG. 2.
Figure 12:
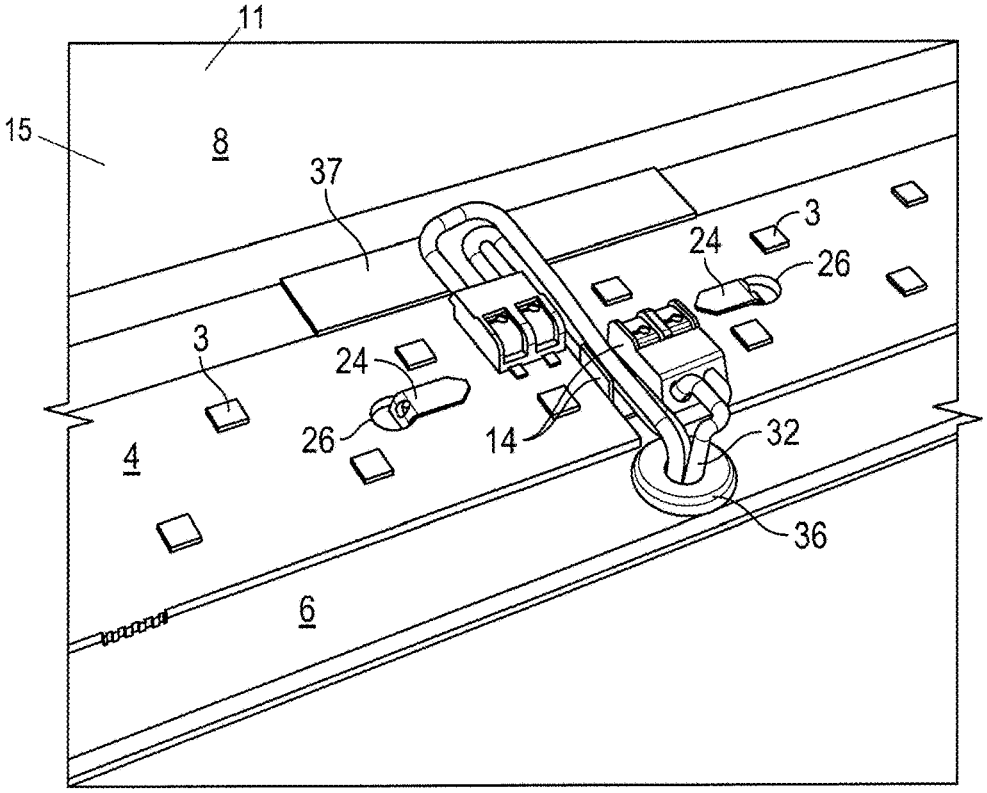
FIG. 12 is yet another partial perspective view of the LED board, the channel and the reflector of FIG. 10.
Figure 13:
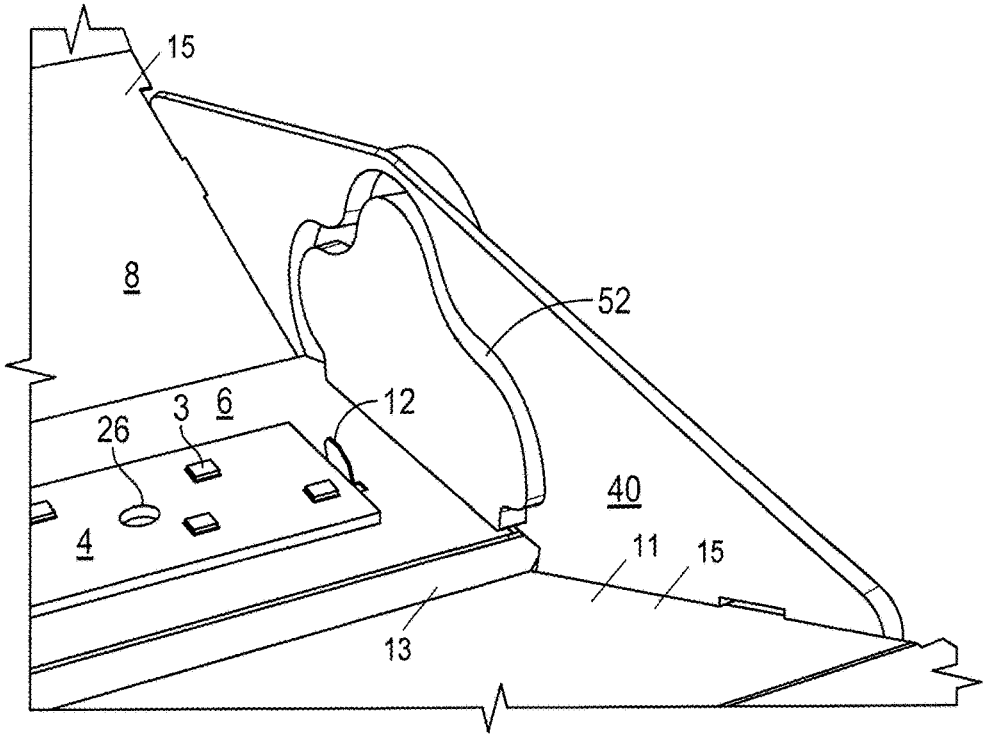
FIG. 13 is a partial perspective view of an embodiment of an end cap positioned on the reflector of FIG. 2.
Figure 14:
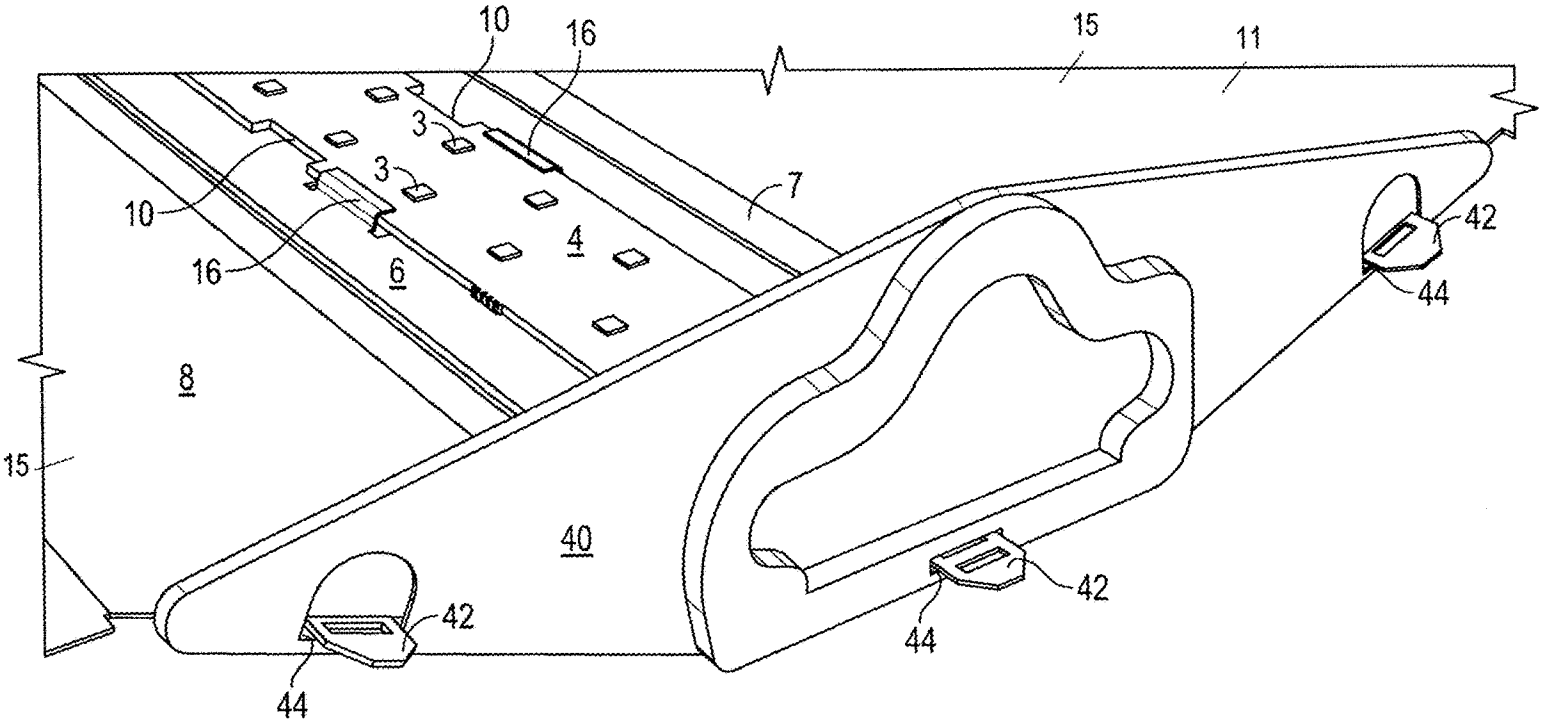
FIG. 14 is another partial perspective view of the embodiment of the end cap positioned on the reflector of FIG. 2.
Figure 15:
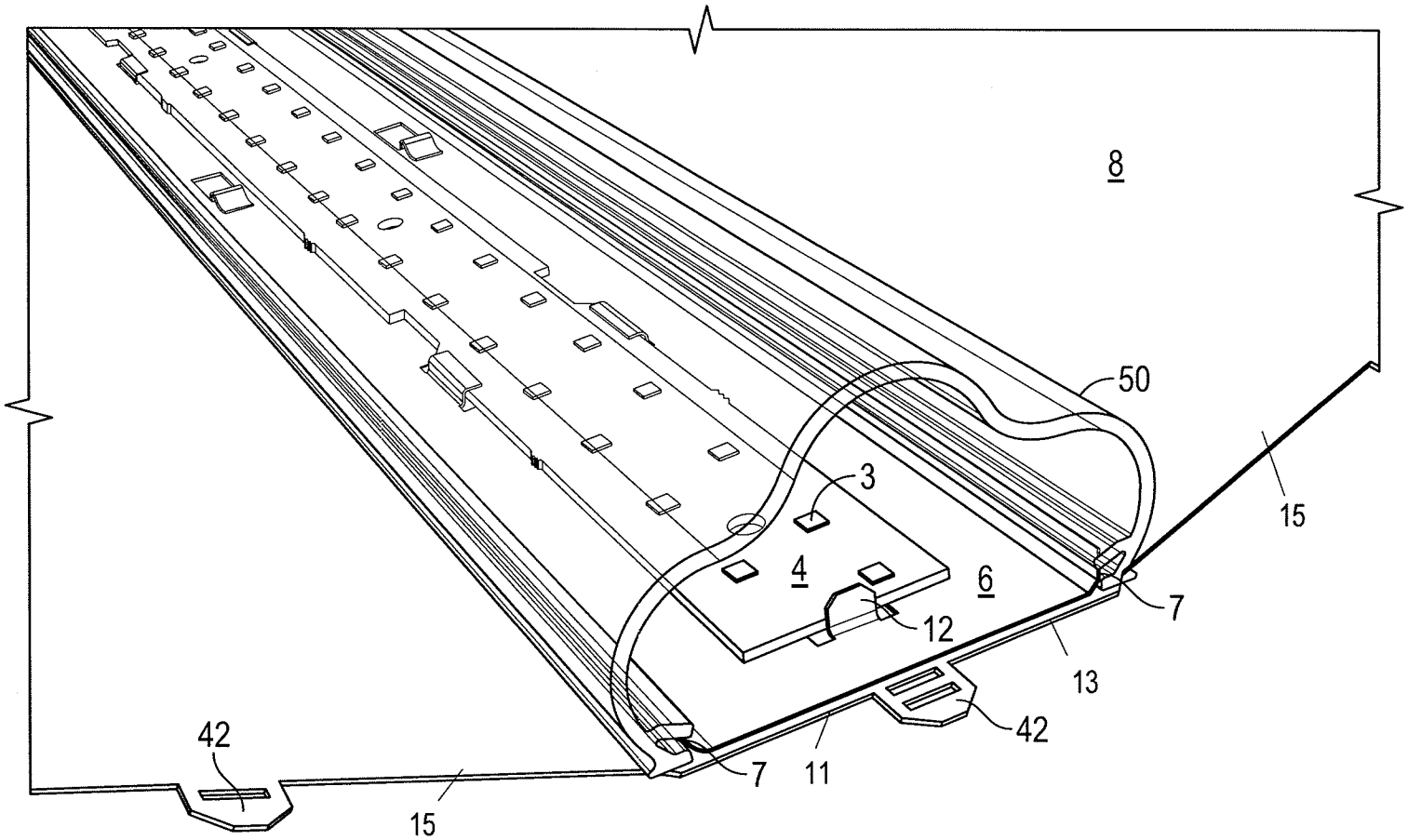
FIG. 15 a partial perspective view of an embodiment of an optic retained on the channel of FIG. 5.
Figure 16:
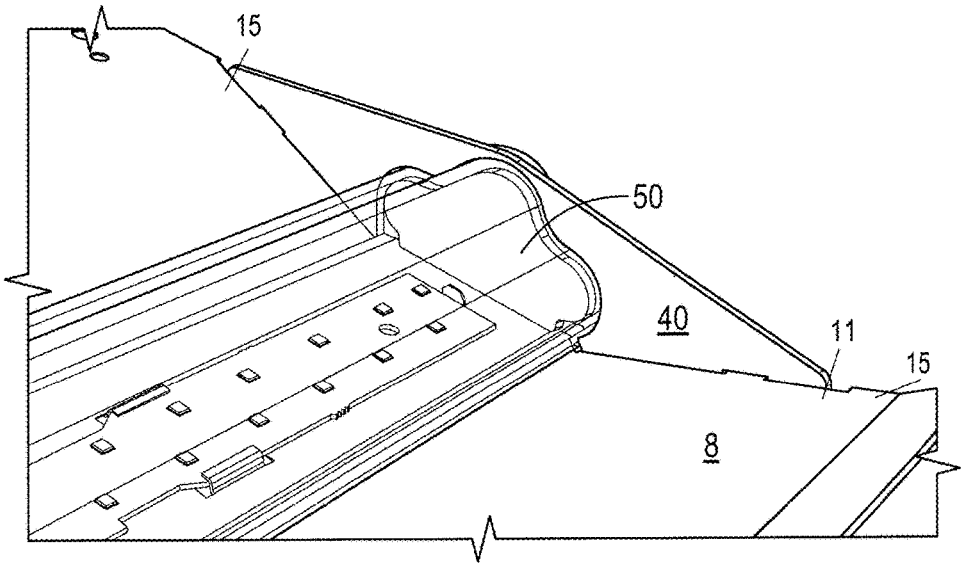
FIG. 16 is a partial perspective view of the optic of FIG. 15 engaging the end cap of FIG. 13.

Referring to FIGS. 9, 10, and 12, to secure the PCB 4 to the channel 6, the PCB 4 is positioned relative to the channel 6 such that the pairs of notches 10 on the PCB 4 align with the pairs of side channel tabs 16 on the channel 6. The notches 10 and side channel tabs 16 are shaped such that the PCB 4 may be moved downwardly onto the channel 6 and the notches 10 pass over and clear the side channel tabs 16 during positioning of the PCB 4. As disclosed above, the pairs of notches 10 need not be laterally aligned but rather may be staggered relative to each other. Similarly, the pairs side channel tabs 16 need not be laterally aligned but rather may be staggered relative to each other. However, the pairs of notches 10 and side channel tabs 16 should be provided such that the notches 10 can align with the side channel tabs 16 to permit clearance of the PCB 4 over the side channel tabs 16 and positioning of the PCB 4 on the channel 6.

During this step, an end of the PCB 4 may rest on the top of the end tab 12 of the channel 6. After aligning the notches 10 of the PCB 4 with the side channel tabs 16 on the channel 6, the PCB 4 may be slid inwardly along the length of the channel 6 such that the side edges of the PCB 4 are trapped beneath the side channel tabs 16 of the channel 6 and the ends of the PCB 4 abut the end tab 12 and central tab 14 of the channel 6. In some examples, sliding the PCB 4 that is initially resting on the top of the end tab 12 includes flexing the PCB 4 such that the PCB 4 can be slid with the side edges of the PCB 4 trapped beneath the side channel tabs 16 and the ends of the PCB 4 abut the end tab 12 and central tab 14. In other embodiments, the notches 10 may be provided on the PCB 4 such that alignment of the notches 10 with the side channel tabs 16 results in an end of the PCB 4 resting on top of a central tab 14. The PCB 4 is then slid in the opposite direction—outwardly along the length of the channel 6—to trap the side edges of the PCB 4 under the side channel tabs 16. In these examples, the PCB 4 is retained on the channel 6 both laterally (by the side channel tabs 16) and longitudinally (by the end tabs 12 and optionally the central tabs 14). One of skill in the art will readily understand that, if a single PCB is used, its ends will abut the end tabs 12 on each end of the channel 6 when installed.

To secure the channel 6 on the reflector 8, the channel 6 is positioned over the reflector 8 so that the reflector clips 22 align with the clip apertures 20 in the channel 6, and the channel 6 may be seated on the reflector 8. Once seated, the channel 6 may be slid relative to the reflector 8 such that the reflector clips 22 engage or clip onto the channel 6 to retain the channel 6 on the reflector 8 (see FIGS. 9 and 10). In the illustrated embodiment, some of the reflector clips 22 are optionally offset from each other along the length of the reflector 8, and the corresponding clip apertures 20 are offset from each other along the length of the channel 6 but positioned so as to align with the reflector clips 22 for engagement as discussed above. Such offset may be desirable, but certainly not required, to ensure that the channel 6 is oriented properly relative to the reflector 8 for wireway alignment, as discussed below. It will be understood that, in this assembly embodiment, the PCB 4 may be secured to the channel 6 before or after the channel 6 is secured to the reflector 8.

Figure 11:
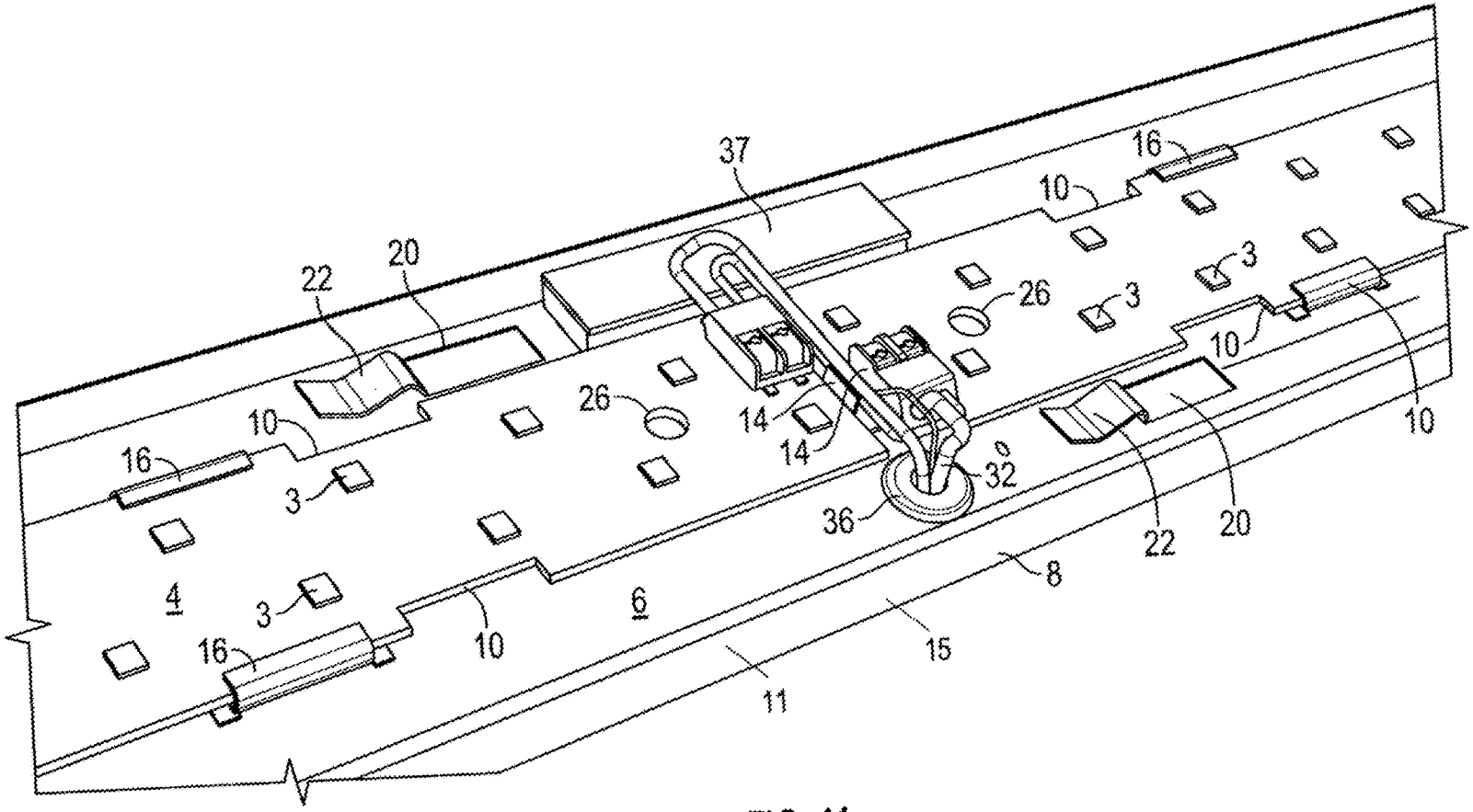
FIG. 11 is another partial perspective view of the LED board of FIG. 9 retained on the channel of FIG. 5, which is retained on the reflector of FIG. 2.

In an alternative assembly embodiment, the notches 10, side channel tabs 16, and reflector clips 22 are not needed. Rather, as illustrated in FIG. 11, the PCB 4, channel 6, and reflector 8 are secured together by the reflector arms 24 extending from the reflector 8 and engaging slots or other shaped apertures 26 in the channel 6 and PCB 4. In some examples, when assembling the PCB 4, channel 6, and reflector 8 in FIG. 11, the channel 6 and PCB 4 are stacked onto the reflector 8 via insertion of the reflector arms 24 into the slots or other shaped apertures 26 on the channel 6 and PCB 4. The reflector arms 24 may be bent to secure the PCB 4, channel 6, and reflector 8 together. Optionally, the reflector arms 24 secure the PCB 4 against the end tabs 12, the central tabs 14, or both.

As previously described, in some embodiments where the driver is positioned above the reflector 8, incoming wires 32 may need to pass through the reflector 8 and channel 6 to reach the PCBs 4. It may be desirable to locate those wires 32 centrally (i.e., center feed the PCB 4) to keep the wires 32 shorter, although such a feature is not required. In the illustrated embodiments, the wires 32 may pass through the aligned wireways 34 and 35 of the reflector 8 and channel 6, respectively, and reach the PCBs 4. A grommet 36 may be located in the wireways 34 and 35 to help further secure the reflector 8 and channel 6 together, as well as create a seal that prevents the ingress of bugs and other debris into the LED luminaire 2.

The wires 32 may be electrically connected to the PCBs 4. In some examples, the space between adjacent central tabs 14 forms a path for the wires 32 that retains the wires 32 in position and prevents them from migrating in front of the LED 3 and creating shadows. In some examples, as illustrated in FIG. 11, device 37, which may be a radio frequency (RF) antenna, infra-red (IR) sensor, various other antennas, various other sensors, various other devices, or various combinations of devices, may be mounted on the channel 6 adjacent to the PCB 4 or directly on the PCB 4 itself. In some examples, the device 37 is mounted through adhesives, although various other suitable mounting mechanisms may be utilized.

Referring to FIGS. 12-15, in some embodiments, the channel 6 includes angled side edges 7 onto which the optic 50 may be snap-fitted.

End caps 40 may be mounted on the ends of the reflector 8 to lock the channel 6 and optic 50 longitudinally in place within the LED luminaire 2 and/or to impart a polished appearance to the fixture. In some embodiments, the optic 50 is retained via tabs 42 extending from the ends of the reflector 8 engaging slots 44 in the end caps 40. See FIGS. 13 and 14. Once the tabs 42 are inserted into the slots 44, they are bent to hold the end caps 40 to the reflector 8. The tabs 42 and slots 44 should not be considered limiting on the current disclosure as various other attachment means and configurations are contemplated.

Grooves 52 having the same or similar profile as the optic 50 may be provided in the end caps 40. When the end caps 40 are mounted, the ends of the optic 50 may seat in the grooves 52 in the end caps 40 to help retain the optic 50 in place within the LED luminaire 2.

Engagement of the PCB 4, channel 6, and reflector 8 results in a complete sealing of any apertures between the components such that the PCB 4/channel 6/reflector 8 barrier is impermeable to bugs, insects and other debris that detrimentally impact operation and light emission of the LED luminaire 2. Engagement of the optic 50 with the channel 6 and positioning of the optic 50 ends within the end caps 40 further helps to seal the LED compartment.

The LED luminaire 2 can be used in new light fixtures or sold as a retrofit kit for use in existing light fixtures already installed in the field (e.g., installed to replace the fluorescent light sources in existing fixtures). The LED luminaire 2 may be used in any type of light fixture, including, but not limited to, recessed troffer, surface mounted, and suspended fixtures.

In some embodiments, the reflector 8 and channel 6 are formed from metallic materials, such as aluminum. In such embodiments, the retention features can be formed by stamping the desired patterns and apertures from the metal and shaping the metal to have the desired geometry.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

That which is claimed is:

1. A luminaire comprising:

a reflector having two opposing ends and a channel-receiving portion, the channel-receiving portion extending between the two opposing ends and comprising reflector clips in the channel-receiving portion;

a channel comprising opposing side edges each having a length, the channel further comprising clip apertures and side channel tabs, wherein the side channel tabs extend a distance along the length of the opposing side edges of the channel and extend upwardly from the channel, the channel mounted on the reflector such that the reflector clips are engaged with the channel through the clip apertures;

a first printed circuit board (PCB) mounted on the channel by positioning opposing side edges of the first PCB under the side channel tabs, the opposing side edges of the first PCB each having a length and notches extending a distance along the length of the opposing side edges of the first PCB, wherein the distance of one of the notches on the first PCB is at least as great as the distance of one of the side channel tabs on the channel such that the notches on the first PCB can receive the side channel tabs;

a second PCB, wherein the channel further comprises center tabs and end tabs, the center tabs between the end tabs, wherein the first PCB is mounted on the channel between a one of the end tabs and a one of the center tabs, wherein the second PCB is mounted on the channel between a second of the end tabs and a second of the center tabs, and wherein the center tabs define a wire pathway between the center tabs, and wherein the wire pathway is dimensioned to accommodate at least one wire of the luminaire; and a plurality of light emitting diodes (LEDs) provided on the first PCB.

2. The luminaire of claim 1, further comprising an optic having opposing ends and opposing side edges that engage the opposing side edges of the channel.

3. The luminaire of claim 2, further comprising a pair of end caps, each one of the pair of end caps mounted to an opposing end of the reflector, wherein each end cap comprises an end cap groove and wherein a one opposing end of the optic engages the end cap groove in one of the pair of end caps.

4. The luminaire of claim 3, wherein the reflector further comprises end cap tabs extending from the opposing ends of the reflector, wherein each one of the pair of end caps comprises end cap slots, and wherein the pair of end caps are mounted at the opposing ends of the reflector such that the end cap tabs extend through the end cap slots.

5. The luminaire of claim 2, wherein the opposing side edges of the channel are angled.

6. The luminaire of claim 1, wherein the clip apertures and side channel tabs of the channel are formed integrally with the channel.

7. The luminaire of claim 1, wherein the end tabs are at opposing ends of the channel.

8. The luminaire of claim 1, further in comprising at least one of a radio frequency (RF) antenna or an infra-red (IR) sensor mounted on the channel adjacent to the first PCB.

9. A luminaire comprising:

a reflector having two opposing ends and a channel-receiving portion, the channel-receiving portion extending between the two opposing ends and comprising reflector arms in the channel-receiving portion;

a channel comprising opposing side edges each having a length, the channel further comprising channel apertures provided along the length of each of the opposing side edges of the channel and end tabs at opposing end edges of the channel, the channel mounted on the reflector such that the reflector arms are engaged with the channel through the channel apertures;

a printed circuit board (PCB) having PCB apertures, the PCB mounted on the channel such that the PCB is between the end tabs of the channel and the reflector arms extend through the PCB apertures; and a plurality of light emitting diodes (LEDs) provided on the PCB, wherein the PCB is a first PCB, wherein the luminaire further comprises a second PCB, wherein the channel further comprises center tabs between the end tabs, wherein the first PCB is mounted on the channel between a one of the end tabs and a one of the center tabs, wherein the second PCB is mounted on the channel between a second of the end tabs and a second of the center tabs, and wherein the center tabs define a wire pathway between the center tabs, and wherein the wire pathway is dimensioned to accommodate at least one wire of the luminaire.

10. The luminaire of claim 9, wherein the reflector further comprises end cap tabs extending from opposing ends of the reflector, and wherein the luminaire further comprises:

a pair of end caps, each one of the pair of end caps having end cap slots, the pair of end caps mounted at the opposing ends of the reflector such that the end cap tabs extend through the end cap slots.

11. The luminaire of claim 10, wherein each one of the pair of end caps comprises an end cap groove, and wherein the luminaire further comprises an optic having opposing ends, wherein each end of the optic engages the end cap groove of one of the pair of end caps.

12. The luminaire of claim 9, further comprising at least one of a radio frequency (RF) antenna or an infra-red (IR) sensor mounted on the channel adjacent to the first PCB.

13. The luminaire of claim 9, further comprising an optic having opposing ends and opposing side edges that engage the opposing side edges of the channel.

14. The luminaire of claim 13, further comprising a pair of end caps, each one of the pair of end caps mounted to an opposing end of the reflector, wherein each end cap comprises an end cap groove and wherein a one opposing end of the optic engages the end cap groove in one of the pair of end caps.

15. The luminaire of claim 14, wherein the reflector further comprises end cap tabs extending from the opposing ends of the reflector, wherein each one of the pair of end caps comprises end cap slots, and wherein the pair of end caps are mounted at the opposing ends of the reflector such that the end cap tabs extend through the end cap slots.

* * * * *